US006994234B2

(12) United States Patent
de Leeuw

(10) Patent No.: US 6,994,234 B2
(45) Date of Patent: Feb. 7, 2006

(54) ELECTRICALLY-OPERATED DISPENSING MODULE

(75) Inventor: Victor de Leeuw, Hilvarenbeek (NL)

(73) Assignee: Nordson Corporation, Westlake, OH (US)

( * ) Notice: Subject to any disclaimer, the term of this patent is extended or adjusted under 35 U.S.C. 154(b) by 119 days.

(21) Appl. No.: 10/406,958

(22) Filed: Apr. 3, 2003

(65) Prior Publication Data

US 2004/0195278 A1 Oct. 7, 2004

(51) Int. Cl.
*F02M 61/00* (2006.01)

(52) U.S. Cl. ..... 222/504; 222/1; 222/146.2; 251/129.02; 251/129.15; 251/129.18; 251/129.19; 239/135; 239/585.1; 239/585.5

(58) Field of Classification Search ..... 222/1, 222/504, 146.1, 146.2, 146.4, 146.5; 251/129.01, 251/129.02, 129.07, 129.18–129.21; 239/135, 239/583, 584, 585.1–586
See application file for complete search history.

(56) References Cited

U.S. PATENT DOCUMENTS

| | | | | |
|---|---|---|---|---|
| 2,114,961 A | | 4/1938 | Gille | 137/139 |
| 2,491,905 A | | 12/1949 | Ray | 62/127 |
| 3,212,715 A | | 10/1965 | Cocks | 239/125 |
| 3,329,347 A | | 7/1967 | Montgomery | 239/583 |
| 3,422,850 A | | 1/1969 | Caldwell | 137/625.65 |
| 3,485,417 A | | 12/1969 | Cocks | 222/146 |
| 3,531,080 A | | 9/1970 | Dillon | 251/129 |
| 3,704,833 A | | 12/1972 | Wheat | 239/585 |
| 3,732,893 A | | 5/1973 | Ziesche et al. | 127/625.65 |
| 3,833,015 A | | 9/1974 | Kneuer | 127/334 |
| 3,912,133 A | | 10/1975 | Hehl | 222/496 |
| 3,921,670 A | | 11/1975 | Clippard, Jr. et al. | 137/625.65 |
| 4,007,880 A | * | 2/1977 | Hans et al. | 239/585.5 |
| 4,218,669 A | | 8/1980 | Hitchcock et al. | 335/258 |
| 4,295,631 A | | 10/1981 | Allen | 251/30 |
| 4,437,488 A | * | 3/1984 | Taggart et al. | 137/334 |
| 4,453,652 A | | 6/1984 | Merkel et al. | 222/504 |
| 4,474,332 A | | 10/1984 | Kaska | 239/585 |
| 4,531,679 A | | 7/1985 | Pagdin | 239/585 |
| 4,981,280 A | | 1/1991 | Brandenberg | 251/26 |
| 4,981,281 A | | 1/1991 | Brundage et al. | 251/30.02 |
| 5,005,803 A | | 4/1991 | Fritz et al. | 251/129.15 |
| 5,022,629 A | | 6/1991 | Tibbals, Jr. | 251/129.02 |
| 5,054,691 A | | 10/1991 | Huang et al. | 239/585 |

(Continued)

FOREIGN PATENT DOCUMENTS

| | | |
|---|---|---|
| DE | 3841474 | 6/1990 |
| WO | WO 97/38798 | 10/1997 |

OTHER PUBLICATIONS

Members of the Staff of the Department of Electrical Engineering, Massachusetts Institute of Technology, *Principles of Engineering Series, Magnetic Circuits and Transformers*, Ch. III. Problems, p. 95 (1944) (3 pages).
Spraymation, Inc., *Exclusive Electromatic Head*, The dripless adhesive applicator with accuracy and speed unmatched by any other system, (Undated) (one page).
Nordson Corporation, *Nordson E–700 Electric Gun*, Jun., 1990, pp. 7–09 to 7–11 (3 pages).

*Primary Examiner*—J. Casimer Jacyna
(74) *Attorney, Agent, or Firm*—Wood, Herron & Evans, L.L.P.

(57) ABSTRACT

Electrically-operated dispensing modules capable of dispensing small volumes of a viscous liquid at high operating frequencies and reproducibly among successive dispensed volumes of viscous liquid without the occurrence of stringing. The dispensing module may include a flux element having a portion effective for interrupting circumferential electrical current paths. In another aspect, an end face of a pole piece of the dispensing module may include one or more non-magnetic spacer elements that prevent contact between the pole piece and armature when the dispensing module is opened.

29 Claims, 5 Drawing Sheets

U.S. PATENT DOCUMENTS

| | | | | | |
|---|---|---|---|---|---|
| 5,178,332 | A | | 1/1993 | Tsukakoshi et al. | 239/552 |
| 5,192,936 | A | | 3/1993 | Neff et al. | 335/281 |
| 5,375,738 | A | | 12/1994 | Walsh et al. | 222/1 |
| 5,535,919 | A | | 7/1996 | Ganzer et al. | 222/1 |
| 5,769,328 | A | * | 6/1998 | Zdyb et al. | 239/585.4 |
| 5,794,825 | A | | 8/1998 | Gordon et al. | 222/504 |
| 5,875,922 | A | * | 3/1999 | Chastine et al. | 222/1 |
| 6,305,583 | B1 | | 10/2001 | Ward et al. | 222/504 |
| 6,318,599 | B2 | | 11/2001 | Estelle et al. | 222/146.5 |
| 6,405,755 | B1 | * | 6/2002 | Doehla et al. | 137/613 |
| 2001/0030307 | A1 | * | 10/2001 | Bergstrom et al. | 251/129.15 |
| 2001/0052585 | A1 | | 12/2001 | Righolt et al. | 251/129.18 |
| 2003/0047627 | A1 | * | 3/2003 | Stier et al. | 239/585.5 |
| 2003/0071148 | A1 | * | 4/2003 | Hohl | 239/585.1 |
| 2003/0205589 | A1 | * | 11/2003 | Righolt et al. | 222/504 |

* cited by examiner

ELECTRICALLY-OPERATED DISPENSING MODULE

FIELD OF THE INVENTION

The invention generally relates to liquid dispensing apparatus and, more particularly, to electrically-operated dispensing modules for dispensing viscous liquids.

BACKGROUND OF THE INVENTION

Electrically-operated dispensing modules have been developed for product assembly lines requiring precise intermittent placement of small amounts of a viscous liquid, such as heated liquid adhesives, at a high speed onto a substrate moving past the liquid dispenser. Generally, an electrically-operated dispensing module includes a magnetic pole piece, a magnetic armature movable relative to the pole piece, a valve stem coupled for movement with the armature, and an electromagnetic coil. The armature is moved relative to the pole piece by selectively energizing and de-energizing the electromagnetic coil. When energized to initiate a dispensing cycle, an electromagnetic field produced by the electromagnetic coil magnetizes the armature and pole piece. The resulting movement of the armature toward the pole piece disengages or unseats the valve stem from the valve seat and opens the dispensing module. When the electromagnetic coil is de-energized, a return spring biases the armature away from the pole piece and this urges the valve stem into contact with the valve seat to close the dispensing module.

The electrically-operated dispensing module is cycled periodically between opened and closed positions to initiate and interrupt fluid flow for dispensing small, discrete volumes a substrate. Depending upon the cycle duration, the small volumes of viscous liquid may be dispensed as spaced-apart, substantially-round dots or as a line of spaced-apart beads. The cycle rate of the dispensing module can define the size and shape of dispensed dots and the characteristics of the leading and trailing edges of dispensed beads.

Conventional electrically-operated dispensing modules include one or more flux elements that strengthen the magnetic field by reducing or preventing magnetic flux loss. These flux elements are typically tubular structures that surround the armature, the electromagnetic coil, and the pole piece. Because the flux elements are formed from an electrically conductive material, the electromagnetic field generated by the electromagnetic coil induces eddy currents that produce electrical currents extending circumferentially about the flux elements. Such circumferential currents retard the dissipation of the magnetic field after the electromagnetic coil is de-energized.

The electromagnetic coil, armature, pole piece and flux elements of conventional electrically-operated dispensing modules participate in forming a magnetic circuit. A typical magnetic circuit incorporates an air gap that dissipates residual magnetism remaining in the magnetic circuit after the electromagnetic coil is de-energized. When conventional electrically-operated dispensing modules are opened, the pole piece and the armature are contacting and are not separated by an air gap. Because the air gap is absent, demagnetization of the pole piece and armature is slowed after the electromagnetic coil is de-energized and residual magnetism tends to hold the armature stationary against the pole piece.

An inability to abruptly remove the attractive force acting between the armature and the pole piece, such as due to the effects of circumferential electrical currents in flux elements and contact between the armature and pole piece, significantly lengthens the time required to shut off the dispensing module. As a result, conventional electrically-operated dispensing modules may not operate at frequencies high enough for certain applications. Also, successive dots tend to grow larger and successive beads tend to lengthen for later-occurring dispensing cycles due to lengthened shut off time.

Most dispensing modules include a removable nozzle containing a discharge passageway from which the small volumes of viscous liquid are dispensed. Usually, the nozzle is not directly heated but, instead, is heated by conduction with adjacent portions of the body of the dispensing module to which the nozzle is attached. The heated portions of the dispensing module are operated at a temperature appropriate for maintaining the viscous liquid at a desired temperature and viscosity without charring or otherwise degrading the physical properties of the viscous liquid. To promote efficient heat transfer to the nozzle, the adjacent module body portion should be formed from a material having high thermal conductivity.

Conventional electrically-operated dispensing modules incorporate an armature guide sleeve, typically formed of a non-magnetic stainless steel, that guides the reciprocating movement of the armature relative to the pole piece. Because of the arrangement of the nozzle and armature within the dispensing module, the guide sleeve is joined with the portion of the module body that is adjacent to the nozzle. The material forming the armature guide sleeve must be compatible with being joined by a process, such as welding or brazing, with the material forming the adjacent module body portion. Therefore, the selection of a non-magnetic stainless steel for forming the armature guide sleeve constrains the material selection for the module body portion to which it is attached, as dissimilar materials are often difficult to join.

A module body portion of stainless steel is readily joined with stainless steel guide sleeves, but stainless steel is a poor heat conductor. A module body portion of brass would promote heat transfer but cannot be joined with a stainless steel armature guide sleeve. Inefficient heat transfer through and from the adjacent module body portion reduces the temperature of the nozzle below the operating temperature of the dispensing module. Increasing the temperature of the dispensing module to increase the temperature of the nozzle is not feasible as the physical properties of viscous liquid within the liquid passageways of the dispensing module would be degraded. The temperature reduction increases the liquid viscosity in the nozzle such that viscous liquid dispensed from the discharge passageway may have a persistent string or tail of viscous liquid. These strings or tails of liquid adversely affect the appearance and/or quality of the finished product. As the substrate moves away from the dispensing module, the strings may also break, become airborne, and land on surrounding equipment, etc. This results in increased maintenance costs and cleaning, as well as potential equipment downtime.

What is needed, therefore, is an electrically-operated dispensing module capable of operating at high frequencies while maintaining reproducibility and accuracy among successive dispensed volumes of viscous liquid and preventing stringing or tailing.

SUMMARY OF INVENTION

The invention provides electrically-operated dispensing modules capable of dispensing small volumes of viscous liquid at high operating frequencies. The invention also provides electrically-operated dispensing modules capable of reproducibly dispensing successive small volumes of viscous liquid. The invention further provides electrically-operated dispensing modules capable of dispensing viscous liquid with a reduced occurrence of stringing.

Generally, the electrically-operated dispensing module of the invention includes a module body having a liquid outlet. A pole piece and an armature are positioned in the module body such that the armature is movable relative to the pole piece between an opened position allowing liquid flow from the liquid outlet and a closed position preventing liquid flow from the liquid outlet. An electromagnetic coil selectively generates an electromagnetic field capable of moving the armature between the opened and closed positions.

According to one aspect of the invention, the electrically-operated dispensing module includes a flux element positioned with a surrounding relationship about at least one of the electromagnetic coil, the armature and the pole piece. The flux element forms at least a portion of an outer housing of the module body. A gap in the flux element is effective for interrupting circumferential electrical current paths in the flux element, which speeds the demagnetization of the pole piece and armature when the electromagnetic coil is de-energized for moving the armature from the opened position to the closed position. This increases the maximum operational frequency of the dispensing module by reducing the time required to move the armature from the opened position to the closed position.

In another aspect of the invention, the pole piece and the armature of the electrically-operated dispensing module have respective confronting end faces. At least one non-magnetic spacer element projects outwardly from the end face of the pole piece and contacts the end face of the armature, when the dispensing module is opened, so that the end faces have a non-contacting relationship. The elimination of face-to-face contact speeds the demagnetization of the pole piece and armature, when the electromagnetic coil is de-energized for moving the armature from the opened position to the closed position, and thereby increases the maximum achievable operational frequency of the dispensing module.

In yet another aspect of the invention, the electromagnetic coil of the electrically-operated dispensing module includes multiple solenoidal windings extending along a longitudinal axis between first and second axial positions, in which the first axial position is closer to the liquid outlet than the second axial position. The armature includes an end face confronting an end face of the pole piece at a third axial position located between a midpoint of the first and second axial positions and the first axial position.

In yet another aspect of the invention, the electrically-operated dispensing module includes a return spring that biases the armature axially away from the pole piece and a nozzle removably attached to a body portion of the module body. The nozzle has a hollow interior which contains a majority of the return spring. This shortens the overall length of the dispensing module.

In yet another aspect of the invention, the electrically-operated dispensing module includes an armature guide sleeve guiding the armature between the opened and closed positions. The armature guide sleeve is joined by a weldment with the manifold body. The material forming the armature guide sleeve has a thermal conductivity greater than the material forming the module body. Forming the module body from a material of relatively high thermal conductivity reduces the incidence of stringing by maintaining the viscous liquid in the liquid outlet at a suitable temperature.

Various additional advantages and features of the invention will become more readily apparent to those of ordinary skill in the art upon review of the following detailed description taken in conjunction with the accompanying drawings.

DETAILED DESCRIPTION

Figure 1:
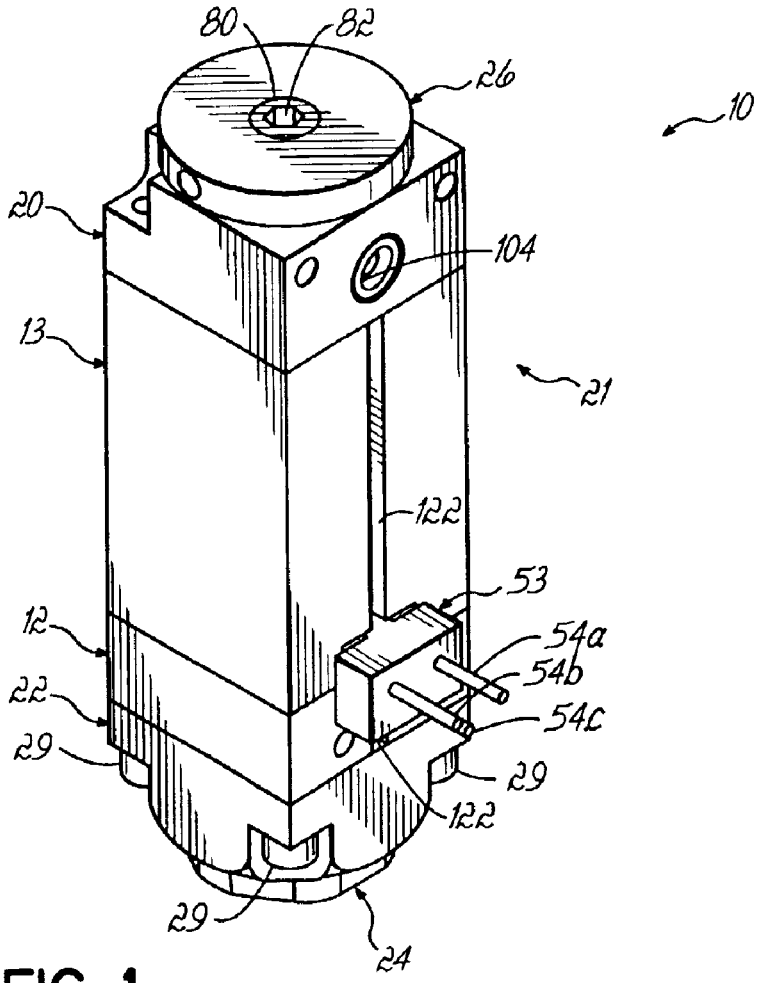
FIG. 1 is a perspective view of an electrically-operated dispensing module in accordance with principles of the invention.
Figure 5:
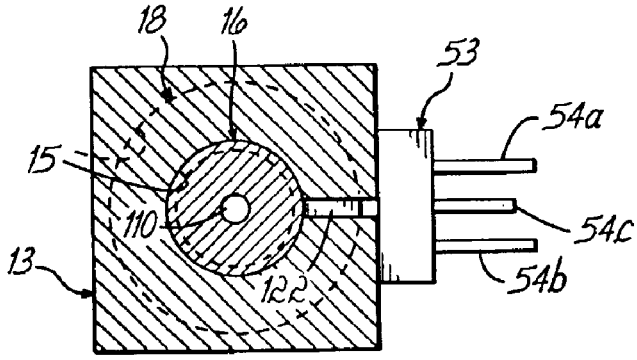
FIG. 5 is a cross-sectional view taken generally along lines 4—4 in FIG. 2.
Figure 2:
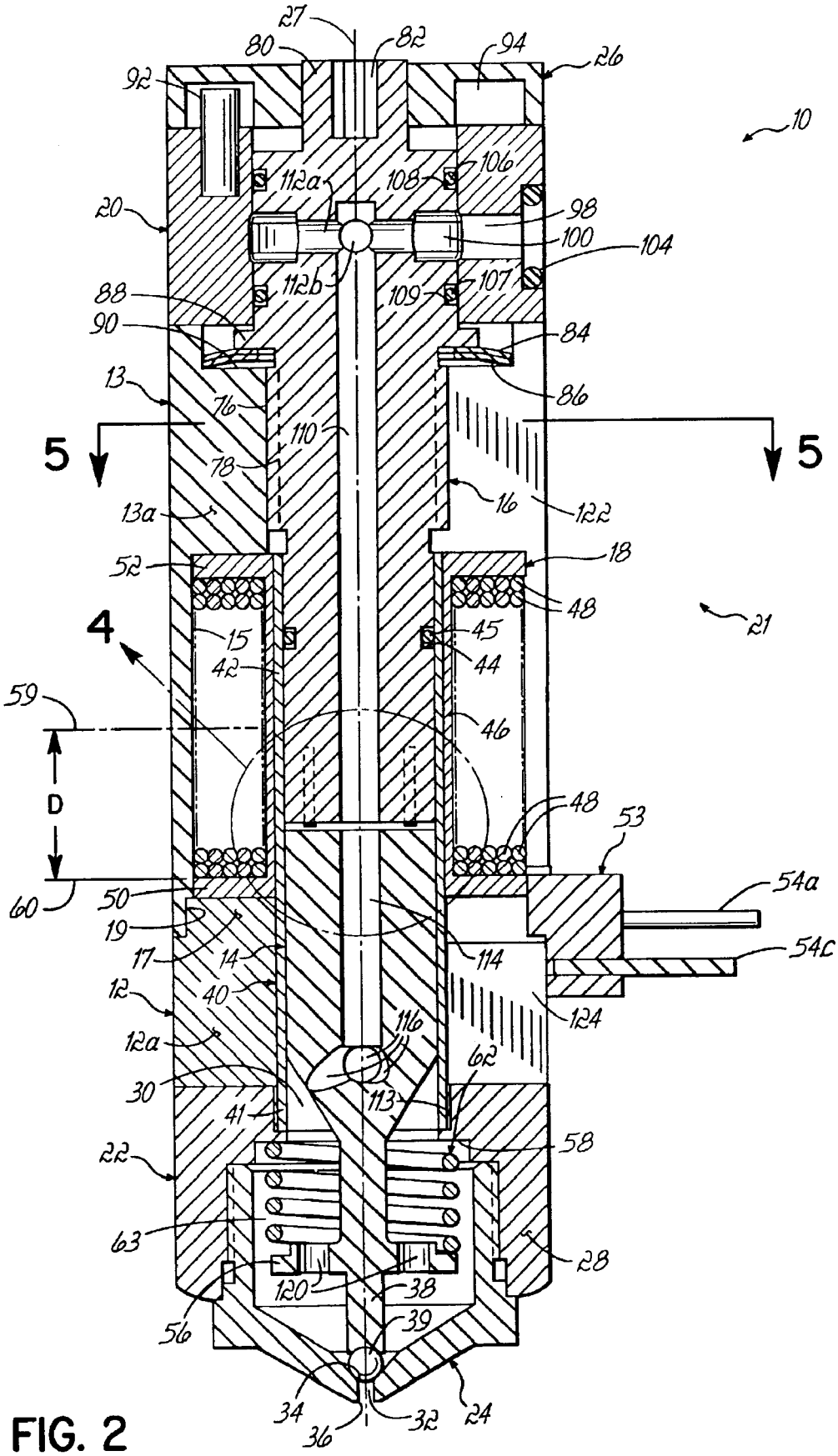
FIG. 2 is a longitudinal cross-sectional view of the dispensing module of FIG. 1 in which the dispensing module is closed.
Figure 3:
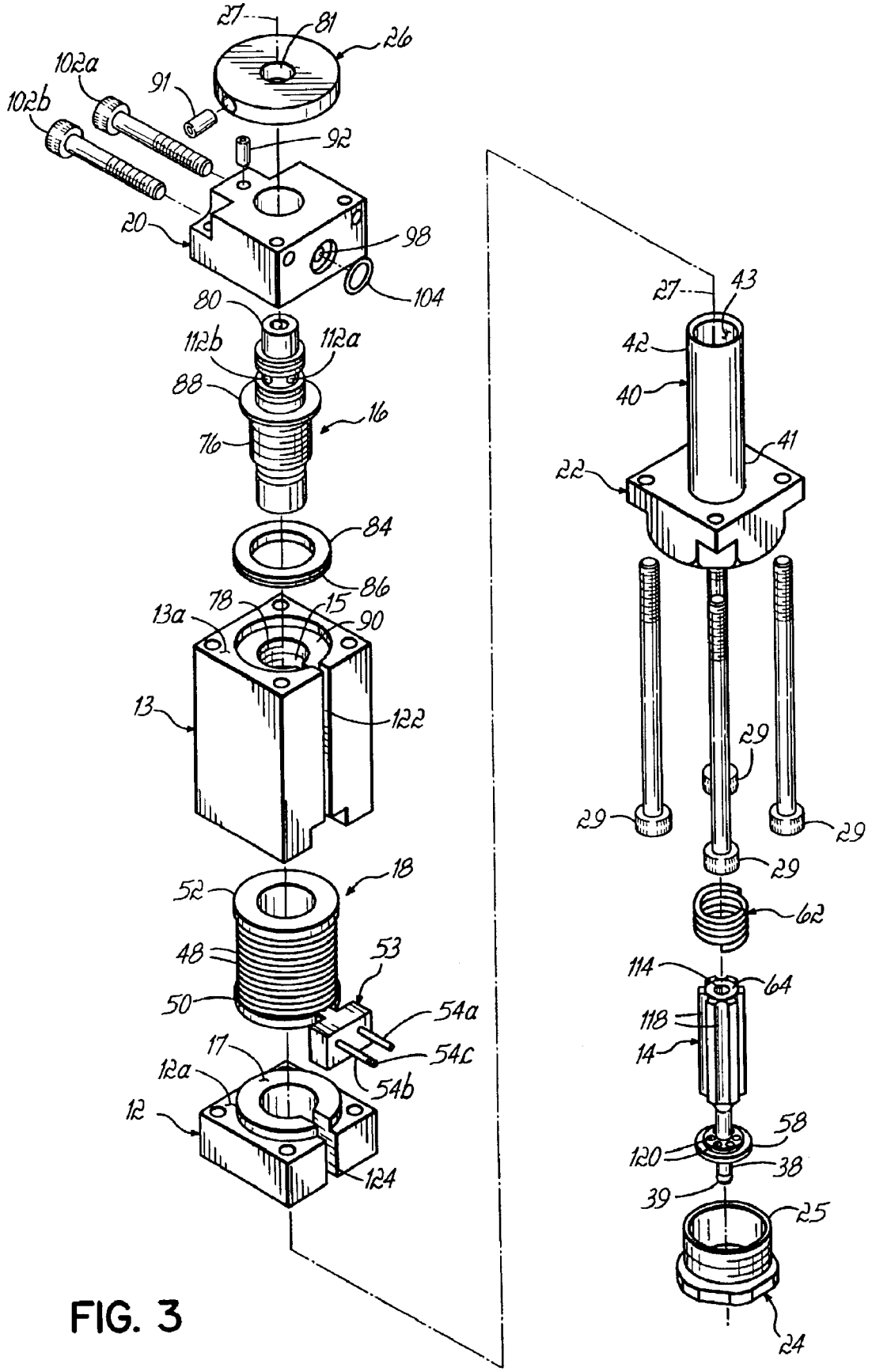
FIG. 3 is an exploded view of the dispensing module of FIG. 1.

With reference to FIGS. 1–3, an electrically-operated dispensing module 10 is provided that is operative for intermittently dispensing viscous liquids. Dispensing module 10 may be used to dispense non-heated viscous liquids, including cold adhesives such as polyvinyl acetate glue, and heated viscous liquids, such as hot melt adhesives. The dispensing module 10 is mounted in a dispensing machine or system (not shown) in a known manner for intermittently dispensing viscous liquid in discrete volumes, such as beads or dots, to provide an interrupted, non-continuous pattern on a moving substrate.

Dispensing module 10 generally includes a lower flux element 12, an upper flux element 13, an armature 14, a pole piece 16, an electromagnetic coil 18, an upper body portion 20 at one end, a lower body portion 22 at an opposite end, and a stroke-adjusting element 26, all of which are generally aligned coaxial with a longitudinal axis 27. The armature 14 is received inside an axially-aligned, stepped-diameter bore 15 of upper flux element 13 and is captured between the lower and upper flux elements 12, 13. The lower flux element 12 has a circumferential flange 17 that is captured inside a circumferential recess 19 in upper lower flux element 12. A plurality of conventional fasteners 29 are utilized for assembling the dispensing module 10. When assembled, the flux elements 12, 13 and module body portions 20, 22 collectively define a module body, generally indicated by reference numeral 21 within which the armature 14, the pole piece 16, and the electromagnetic coil 18 are housed. The lower and upper flux elements 12, 13 are typically tubular structures that have a surrounding relationship with at least one of the armature 14, the pole piece 16, and the electromagnetic coil 18.

For purposes of this description, words of direction such as "upward," "vertical," "horizontal," "right," "left,"

"upper," "lower," "above," and the like are applied in conjunction with the drawings for purposes of clarity in the present description only. As is well known, liquid dispensing modules may be oriented in substantially any orientation, so these directional words should not be used to imply any particular absolute directions for an apparatus consistent with the invention.

With continued reference to FIGS. 1–3, dispensing module 10 further includes a nozzle 24 that can be readily exchanged with a different nozzle for dispensing dots or beads of viscous liquid having a different size and/or shape. Nozzle 24 has an externally-threaded, cylindrical side wall 25 mounted removably in a threaded engagement with an internally-threaded side wall 28 of the lower body portion 22. A liquid outlet 32 extends between a valve seat 34 and a discharge orifice 36 for defining a flow path out of nozzle 24.

A valve stem 38 projecting from the armature 14 carries a valve element 39, which is dimensioned and shaped to seat against valve seat 34 for establishing a liquid-tight engagement therebetween when the dispensing module 10 is closed. A liquid chamber 30 provides a liquid reservoir from which metered volumes of viscous liquid are transferred to the liquid outlet 32 of nozzle 24. Dispensing module 10 is closed when the valve element 39 contacts the valve seat 34 in a closed position, such that viscous liquid cannot flow from the liquid chamber 30 through the liquid outlet 32 to the discharge orifice 36. Dispensing module 10 is opened when the valve element 39 is disengaged from the valve seat 34 in an opened position to define an annular flow path therebetween, so that viscous liquid can flow from the liquid chamber 30 through the annular flow path to the liquid outlet 32 and, eventually, to the discharge orifice 36.

With continued reference to FIGS. 1–3, a thin-walled, axially-extending armature guide sleeve 40 disposed inside bore 15 supports the armature 14 for sliding, reciprocating movement of the valve element 39 to establish contacting and non-contacting relationships with the valve seat 34. A lower end 41 of the armature guide sleeve 40, which is formed of a nonmagnetic material, is joined to the lower body portion 22 by vacuum welding. A portion of the pole piece 16 fills an upper end 42 of armature guide sleeve 40. A circumferential groove 44 in pole piece 16 confines a sealing member 45, such as an elastomer O-ring, capable of providing a liquid seal with the armature guide sleeve 40. Liquid chamber 30 is defined inside lower body portion 22 and guide sleeve 40 by the volume that is not occupied by the armature 14, the pole piece 16, the nozzle 24, and a return spring 62.

The wall thickness of armature guide sleeve 40, measured in a radial direction relative to longitudinal axis 27, is subject to certain design requirements. The wall thickness of armature guide sleeve 40 must be sufficiently thin for minimizing losses in the electromagnetic field transferred to the armature 14 from electromagnetic coil 18. A typical wall thickness for the armature guide sleeve 40 is about 0.5 mm.

With continued reference to FIGS. 1–3, the electromagnetic coil 18 includes a spool 46 and multiple turns or windings 48 of an electrical conductor wrapped solenoidally about the spool 46. The windings 48 are potted in an electrically insulating material, such as an epoxy, and the composite structure is constrained against axial movement by an axially-spaced pair of radially-extending lower and upper flanges 50, 52. The windings 48 of the electromagnetic coil 18 are coupled electrically with electrical contacts 54*a–c* housed within an electrically-insulating housing 53. The electrical contacts 54*a–c* are suitable for engagement with the conductors of a cable extending to a power source (not shown). The spool 46 is positioned radially outward of the armature 14 and pole piece 16 with a generally surrounding relationship and is aligned coaxially relative to the longitudinal axis 27 by armature guide sleeve 40.

Compressed between a radially-projecting flange 56 of the armature 14 and an annular shoulder 58 in the lower body portion 22 is return spring 62 that biases the armature 14 in an axial direction generally parallel to longitudinal axis 27 away from the pole piece 16. The biasing force applied by the return spring 62 urges valve element 39 into contact with valve seat 34, and maintains the contact therebetween, when the electromagnetic coil 18 is de-energized for closing dispensing module 10. Return spring 62, as illustrated in FIG. 2, is located axially in the liquid chamber 30 in its entirety within the axial extent of the side wall 25 of nozzle 24, which defines a hollow interior 63. This axial position of return spring 62 preferably positions at least 75% of the return spring 62 within hollow interior 63. In addition, the flange 56 is likewise disposed in the hollow interior 63. According to the principles of the invention, a majority of the return spring 62 is located axially within the hollow interior 63, which shortens the overall height of the dispensing module 10 while providing effective spring biasing of the armature 14 away from the pole piece 16.

With continued reference to FIGS. 1–3, the dispensing module 10 is cycled to its opened condition by energizing the electromagnetic coil 18 with a sufficient coil current or power so that the generated electromagnetic field produces an attractive force between the armature 14 and the pole piece 16 of a magnitude effective for overcoming the biasing force applied by the return spring 62. Because the pole piece 16 is stationary, the attractive force causes the armature 14 to move toward the pole piece 16. The movement of the armature 14 toward the pole piece 16 disengages the valve element 39 from the valve seat 34 for opening the dispensing module 10. Viscous liquid can flow from the liquid chamber 30 through an annular flow path defined between the valve seat 34 and valve element 39 to the liquid outlet 32 and, eventually, to the discharge orifice 36. Power is sustained to the electromagnetic coil 18 to maintain the attractive force for a time sufficient to allow the desired volume of viscous liquid to flow in the annular flow path between valve seat 34 and valve element 39. The electromagnetic coil 18 is de-energized to close dispensing module 10 and cause the valve element 39 to contact the valve seat 34 in a closed position preventing liquid flow from the liquid chamber 30 through the liquid outlet 32 to the discharge orifice 36.

With reference to FIGS. 2, 4A, 4B, and 6A, the armature 14 has an annular end face 64 positioned with a confronting and generally parallel relationship with an annular end face 66 of the pole piece 16. A plurality of, for example, three spacer elements 68*a–c* are provided on the end face 66 of pole piece 16. Preferably, the spacer elements 68*a–c* are arranged with a uniform angular spacing about a common radius. Each of the spacer elements 68*a–c* includes a shaft 70*a–c* inserted in a corresponding one of a plurality of blind bores 72*a–c* provided in pole piece 16. The spacer elements 68*a–c* are formed from a non-magnetic material. Suitable non-magnetic materials for forming spacer elements 68*a–c* include austenitic stainless steels, such as 300 Series austenitic stainless steels, and ceramics, such as silicon nitride or zirconium oxide.

Figure 4B:
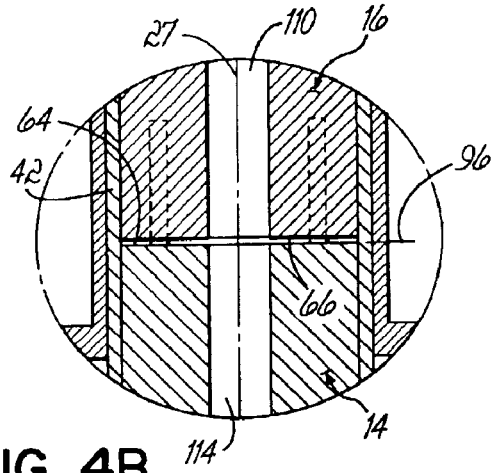
FIG. 4B is a detailed cross-sectional view similar to FIG. 4A in which the dispensing module is opened.

Each of the spacer elements 68*a–c* projects beyond a plane containing the end face 66 of pole piece 16. When dispensing module 10 is in the opened position (FIG. 4B), the spacer elements 68*a–c* act to prevent physical contact between the end face 64 of armature 14 and the end face 66. Each of the spacer elements 68*a–c* projects the same distance above the end face 66 of pole piece 16 so that the separation between end face 64 and end face 66 is uniform. As a result of the non-contacting relationship between end faces 64, 66, the magnitude of the force attracting the armature 14 toward the pole piece 16 is relatively constant when the dispensing module 10 is opened. In one specific embodiment of the invention, the spacer elements 68*a–c* project outwardly about 0.1 mm from the end face 66 of pole piece 16 and adjacent pairs of spacer elements 68*a–c* have an angular separation about longitudinal axis 27 of about 120°. The tips of the spacer elements 68*a–c* may be blunt and planar, as illustrated in FIGS. 4A, 4B and 4A, radiused to be convex or domed, or radiused to be concave or cusped.

Figure 4A:
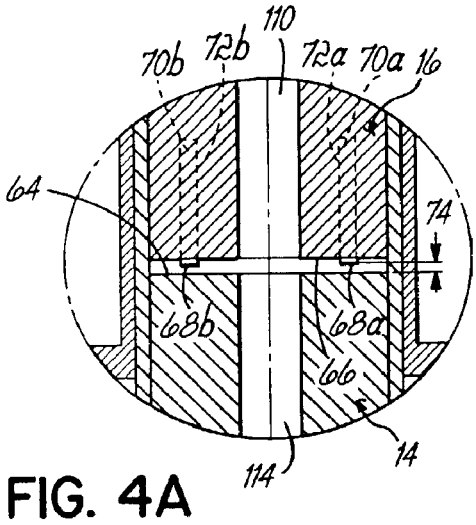
FIG. 4A is a detailed cross-sectional view of a portion of FIG. 2.

The spacer elements 68*a–c* operate for reducing the time to cycle the dispenser module 10 from the opened position (FIG. 4B) to the closed position (FIG. 4A). When the electromagnetic coil 18 is de-energized to discontinue the electromagnetic field, the magnetic force that the return spring 62 must overcome is less than if the end faces 64, 66 had been contacting when the dispensing module 10 was opened due to the introduction of a gap. In addition, the presence of the spacer elements 68*a–c* permits the magnetic field to be collapsed and the armature 14 and pole piece 16 to be demagnetized in a reproducible manner and more rapidly than if the end faces 64, 66 are contacting when the dispensing module 10 is opened. The spacer elements 68*a–c* also operate to widen the gap between the end faces 64, 66 when the dispensing module 10 is open, which reduces the squeeze film forces that tend to cause residual adhesion between the end faces 64, 66 that would otherwise retard the movement of the armature 14 away from the pole piece 16 when the electromagnetic field is removed.

Incorporating the spacer elements 68*a–c* integrally into the armature 14 rather than the pole piece 16 provides certain benefits. For example, the armature 14 is formed from a mass of magnetic material that is less than the mass of magnetic material forming the pole piece 16. It is desirable to minimize the mass of the armature 14 because reductions in armature mass decrease the inertia that must be overcome for initiating movement of armature 14. Magnetic material is removed from the pole piece 16 for attaching the spacer elements 68*a–c*, such as the material removed to create blind bores 72*a–c*. By attaching the spacer elements 68*a–c* to the more-massive pole piece 16, the loss of magnetic material is percentage-wise significantly less than if material were removed correspondingly from the less-massive armature 14. Therefore, a larger attractive force can be applied between the armature 14 and pole piece 16 for an equivalent electromagnetic field strength because the spacer elements 68*a–c* are incorporated into the pole piece 16 rather than the armature 14.

With reference to FIGS. 1–3, 4A and 4B, the axial extent of the travel of armature 14 toward pole piece 16 defines a stroke length that determines the axial separation of the valve element 39 from the valve seat 34 when dispensing module 10 is opened. When dispensing module 10 is closed (FIG. 4A), the stroke length is equal to the width of a gap 74 existing between end face 64 of armature 14 and the tips of spacer elements 68*a–c* extending from end face 66 of pole piece 16. The width of gap 74 is adjusted by adjusting the axial position of the pole piece 16 so that the valve element 39 engages the valve seat 34 and, then, by withdrawing the pole piece 16 using the calibrated stroke-adjusting element 26 to precisely set the stroke length. Typical stroke lengths for dispensing module 10 are less than about 0.3 millimeters.

The adjustability of the axial position of the pole piece 16 is provided by an externally-threaded portion 76 of the pole piece 16 that is mated with an internally threaded portion 78 of the upper flux element 13. A reduced-diameter end 80 of the pole piece 16 includes a drive recess 82, such as a hex head or a cross slot, capable of being engaged by a correspondingly shaped end of a driving tool or implement (not shown), such as a hex wrench or a slotted-type screwdriver, for rotating the pole piece 16 relative to the upper flux element 13. Rotation in one sense about longitudinal axis 27 advances end face 66 of pole piece 16 toward the end face 64 of armature 14 and rotation in the opposite sense about longitudinal axis 27 withdraws the end face 66 of pole piece 16 away from the end face 64 of armature 14.

With reference to FIGS. 1–3, a pair of spring washers 84, 86 are captured between a flange 88 projecting radially outward from the pole piece 16 and a counterbore 90 formed in the upper flux element 13. The spring washers 84, 86 collectively apply an axial bias force that removes the axial free play between the threaded portions 76, 78 and resists unintentional axial movement of the pole piece 16. The presence of the axial bias force supplied by spring washers 84, 86 precisely defines and maintains a selected stroke length with an accuracy of 0.01 mm. A set screw 91 is loosened and tightened for uncoupling and coupling, respectively, stroke-adjusting element 26 with the reduced-diameter end 80 of pole piece 16.

The upper body portion 20 includes an outwardly-projecting pin 92 that travels in a closed-ended, semi-circular channel 94 in the confronting face of the stroke-adjusting element 26 for limiting the arc through which stroke-adjusting element 26 can rotate. When set screw 91 is tightened, the pin 92 and channel 94 cooperate to limit adjustment of the axial position of the pole piece 16 and thereby cooperate for limiting the range available for adjusting the stroke.

The capability of adjusting the axial position of the pole piece 16 provides various benefits. As the valve seat 34 and valve element 39 wear, the axial position of the pole piece 16 may be readjusted as required using stroke-adjusting element 26 and drive recess 82 to maintain a desired stroke length. In addition, the ability to adjust the axial position of the pole piece 16 permits compensation for dimensional uncertainties of the armature 14 and nozzle 24 resulting from manufacturing tolerances.

With reference to FIGS. 2 and 4B, the end face 64 of armature 14 confronts the end face 66 of pole piece 16 at an interface 96 defined along longitudinal axis 27. The windings 48 of the electromagnetic coil 18 are positioned along the longitudinal axis 27 over an axial range, D, that extends between a first axial position 59 defined by the axial midpoint of the windings 48 and a second axial position 60 defined by the lowest axial point of the windings 48 adjacent to lower flange 50. Interface 96 is located near the midpoint of axial range, D. The invention contemplates that interface 96 may be located at any axial position between the first and second axial positions 59, 60.

With reference to FIGS. 1–3, extending through one side wall of the upper body portion 20 is a liquid inlet 98 that transfers viscous liquid received from a supply passageway in a liquid manifold (not shown) to an annular liquid passageway 100 extending about a circumference of the pole piece 16. Conventional fasteners 102*a,b* are used for coupling the manifold (not shown) to the dispensing module 10 so that the liquid inlet 98 is in fluid communication with the supply passageway. A sealing member 104, such as an elastomer O-ring, positioned in a counterbored length of the liquid inlet 98 supplies a liquid seal.

The annular liquid passageway 100 is coupled in fluid communication with an axial flow passageway 110 in pole piece 16 by a plurality of, for example, two diametrical flow passageways 112*a,b*. A pair of sealing members 106, 107, such as elastomer O-rings, each positioned in a corresponding one of a pair of annular grooves 108, 109 supply liquid seals that prevent leakage from the annular liquid passageway 100. The axial flow passageway 110 extends along the longitudinal axis 27 of pole piece 16 and is coupled in fluid communication with an axial flow passageway 114 in the armature 14. A plurality of, for example, three angled flow passageways 116*a–c* couple the axial flow passageway 114 in fluid communication with the liquid chamber 30.

Viscous liquid from the axial flow passageway 110 also flows about the exterior of the armature 14 to the liquid chamber 30. The clearance space defined between the armature 14 and a radially-innermost side wall 43 of armature guide sleeve 40 permits rotation and longitudinal translation of the armature 14 relative to armature guide sleeve 40. The presence of the spacer elements 68*a–c*, best shown in FIGS. 4A and 4B, contributes to spacing the end faces 64, 66 apart to provide a radially-outward flow path therebetween, when the dispensing module 10 is opened, through which viscous liquid may flow radially outward. Axial slots or grooves 118 in the radially-outermost surface of the armature 14 assist liquid flow and decrease fluid resistance to reciprocating movement of armature 14. Circular flow passages 120 extending through the thickness of the flange 56 of armature 14 further reduce fluid resistance to movement of armature 14 by providing flow paths for the viscous liquid traveling toward the discharge orifice 36.

Dispensing module 10 is depicted as a top-feed device in which the liquid inlet 98 is positioned in the upper body portion 22 axially above the electromagnetic coil 18. However, the invention is not so limited as principles of the invention are equally applicable to dispensing modules that are bottom-feed devices in which liquid inlet 98 is positioned axially below the electromagnetic coil 18, such as, for example, in the lower body portion 20.

With continued reference to FIGS. 1–3 and 5, the flux elements 12, 13 are constituted by tubular side walls 12*a*, 13*a*, respectively, coaxially aligned with longitudinal axis 27. The side walls 12*a*, 13*a* have a rectangular cross-section viewed parallel to longitudinal axis 27. A gap or slot 122 extends along the entire axial dimension or height of the upper flux element 13 and completely through the thickness of side wall 13*a*. Similarly, the lower flux element 12 also includes a full-height longitudinal gap or slot 124 extending substantially parallel to longitudinal axis 27 and completely through the thickness of side wall 12*a*. The slots 122, 124 interrupt potential closed-loop current paths in the lower and upper flux elements 12, 13, so that circumferential or azimuthal electrical currents are not induced in the lower and upper flux elements 12, 13 by eddy currents resulting from the operation of the electromagnetic coil 18.

As depicted in FIGS. 1–3 and 5, the slots 122, 124 are aligned axially substantially parallel to longitudinal axis 27. However, the invention is not so limited in that the slots 122, 124 merely need to provide a discontinuity along the full axial extent of side walls 12*a*, 13*a*, respectively, for eliminating circumferential current paths. Each of the slots 122, 124 may be filled with an electrically-insulating material, such as a potting material, that cooperates with the slot width to eliminate circumferential electrical currents arising from eddy currents induced by the electromagnetic field.

The slots 122, 124 should be sufficiently wide in the circumferential direction to prevent transfer of a significant number of magnetic field lines across the respective gaps. For typical operating parameters of coil 18, the width of slots 122, 124 is greater than about 2 mm. The slot width is limited, however, to minimize the reduction in mass of the flux elements 12, 13. The presence of the slots 122, 124 increases the upper operational threshold on the cycle rate of dispensing module 10 as the magnetic field in flux elements 12, 13 dissipates more quickly, after the electromagnetic coil 18 is de-energized, due to the elimination and absence of circumferentially-extending electrical currents. As a result, the dispensing module 10 can operate at relatively high switching frequencies as compared with conventional dispensing modules lacking such slots 122, 124.

The pole piece 16 and the armature 14 are fabricated from a soft magnetic alloy, such as an alloy selected from the CHROME CORE® family of corrosion-resistant, ferritic, chromium-iron alloys commercially available from Carpenter Technology (Reading, Pa.). Alternatively, the armature 14 and pole piece 16 may be fabricated from a ferritic chromium-iron stainless alloy, preferably of solenoid quality, such as Type 430F and Type 430FR stainless alloys, which are commercially available, for example, from Carpenter Technology (Reading, Pa.).

Armature guide sleeve 40 is formed of nonmagnetic material, such as an austenitic stainless steel and, more particularly, a 300 Series austenitic stainless steel containing about 16% to 30% chromium and about 2% to 20% nickel. Nickel, which modifies the physical structure of the stainless steel forming armature guide sleeve 40 to make it nonmagnetic, also significantly reduces the thermal conductivity. The lower body portion 22 is formed from a nonmagnetic material that is chemically inert. Constructing the lower body portion 22 from a material of a relatively low thermal conductivity, such as an austenitic stainless steel, would be appropriate for dispensing non-heated viscous liquids in which heat transfer is unimportant and represents minor difficulty in joining by a weldment 113 (FIG. 2) with armature guide sleeve 40.

In specific applications in which the viscous liquid is heated, the material forming the lower body portion 22 has a relatively high thermal conductivity for effectively transferring heat from the lower flux element 12 to the nozzle 24 and the viscous liquid confined within liquid chamber 30. Efficient heat transfer from the lower body portion 22 to the viscous liquid within liquid chamber 30 is important for preventing cooling of the viscous liquid in the liquid outlet 32 that would otherwise increase the viscosity of the viscous liquid and result in stringing from discharge orifice 36.

The thermal conductivity of the material forming the lower body portion 22 is greater than the thermal conductivity of the material forming the guide tube 40. Typically, the thermal conductivity of the lower body portion is greater than and, preferably significantly greater than, the thermal conductivity of austenitic stainless steels. In certain embodiments, the thermal conductivity of the material forming the lower body portion 22 is greater than about 20 W/(m·K) measured at room temperature. The high thermal-conductivity material forming the lower body portion 22 is also compatible with being joined by weldment 113 with the non-magnetic material forming the guide sleeve 40. After weldment 113 is formed, the lower body portion 22 may be nickel plated. Exemplary materials having a relatively high thermal-conductivity suitable for forming the lower body portion 22 are the nickel-free AMPCOLOY® copper alloys commercially available from Ampco Metal, Inc.

(Milwaukee, Wis.), which are readily vacuum welded or vacuum soldered with austenitic stainless steels.

In use and with reference to FIGS. 1–5 and 6A, the electromagnetic coil 18 is periodically powered or energized for moving the armature 14 relative to the pole piece 16 to open and close the dispensing module 10. When the electromagnetic coil 18 is powered, the electromagnetic field produced by the electromagnetic coil 18 causes the armature 14 to be attracted toward the pole piece 16. The movement of the armature 14 disengages the valve element 39 from the valve seat 34, which opens the dispensing module 10 to dispense viscous liquid from the liquid chamber 30 through the liquid outlet 32 and, subsequently, the discharge orifice 36.

Power is supplied to the windings 48 of electromagnetic coil 18 to hold the armature 14 in the opened position relative to the pole piece 16 for a duration effective to allow a desired volume of viscous liquid to flow through the annular gap between valve element 39 and valve seat 34. While the electromagnetic coil 18 is energized, the longitudinal slots 122, 124 in flux elements 12, 13 interrupt potential closed-loop current paths so as to eliminate circumferential currents that opposed demagnetization after the electromagnetic coil 18 is de-energized. In addition, spacer elements 68*a–c* prevent physical contact between the end face 64 of armature 14 and the end face 66 of pole piece 16, which permits rapid demagnetization of the armature 14 and pole piece 16 after the electromagnetic coil 18 is de-energized.

When the dispensing module 10 is opened, viscous liquid enters the liquid inlet 98 and is transferred by the diametrical flow passageways 112*a,b* to the axial flow passageway 110. Viscous liquid flows through the axial flow passageway 110 to the vicinity of the interface 96. A portion of the viscous liquid from axial flow passageway 110 flows radially outward through interface 96 and, thereafter, flows in axial grooves 118 and in the clearance space between the exterior of the armature 14 and the radially-innermost side wall 43 of armature guide sleeve 40 to the liquid chamber 30. Another portion of the viscous liquid is transferred to the axial flow passageway 114. Viscous liquid is transferred by angled flow passageway 116*a–c* from the axial flow passageway 114 to the liquid chamber 30 and, subsequently, to the discharge orifice 36.

At the conclusion of a dispensing cycle and with reference to FIG. 3, the attractive force acting between the armature 14 and the pole piece 16 is discontinued by de-energizing the electromagnetic coil 18. The armature 14 is restored to its original position by action of the return spring 62. Cyclic movement of the armature 14 relative to the pole piece 16 provides the opened and closed positions, which causes metered volumes of viscous liquid to be dispensed intermittently from discharge orifice 36.

The non-magnetic spacer elements 68*a–c* and the current-dissipating longitudinal slots 122, 124, either individually or collectively, decrease the time required to close the dispensing module 10 by facilitating rapid demagnetization of the armature 14 and pole piece 16. As a result, the demagnetization performance of the dispensing module 10 is significantly improved.

Figure 6A:
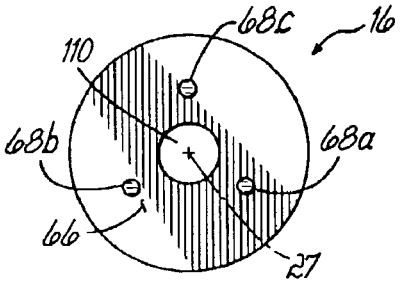
FIG. 6A is a bottom view of the end face of the pole piece of the dispensing module of FIG. 1.
Figure 6B:
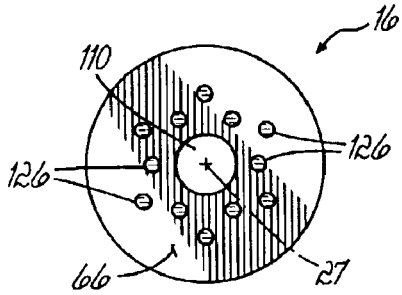
FIGS. 6B–G are bottom views similar to FIG. 6A illustrating alternative embodiments of the end face of the pole piece in accordance with the principles of the invention.
Figure 6C:
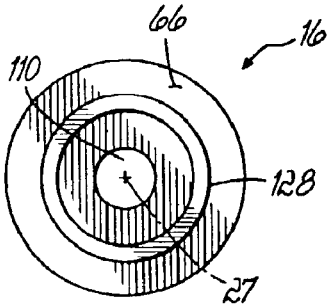
Figure 6D:
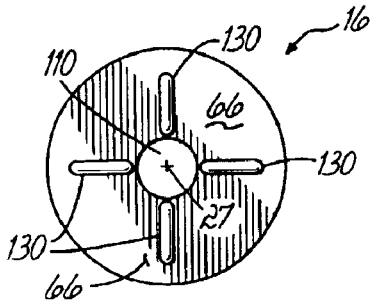
Figure 6E:
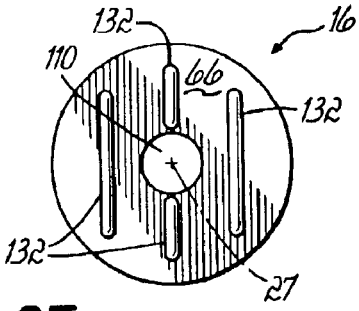
Figure 6F:
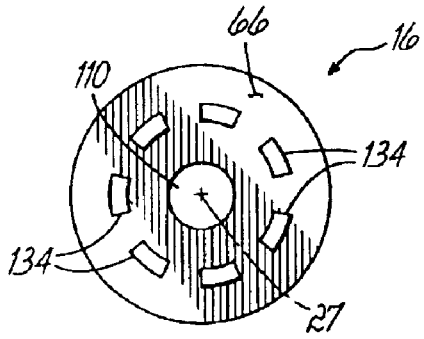
Figure 6G:
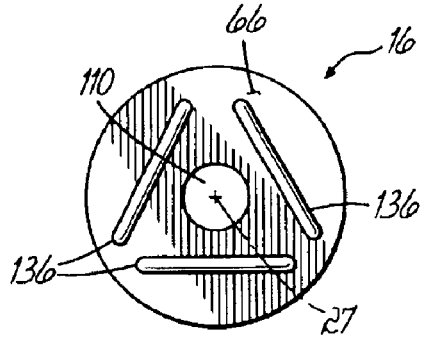

With reference to FIGS. 6B–G in which like reference numerals refer to like features in FIG. 6A, the end face 66 of pole piece 16 may incorporate different arrangements of non-magnetic spacer elements capable of providing a non-contacting relationship with end face 64 (FIG. 4A). Referring specifically to FIG. 6B and in accordance with an alternative embodiment of the invention, end face 66 may include a plurality of non-magnetic spacer elements 126 arranged in concentric circular patterns having two distinctly different radiuses relative to longitudinal axis 27. It is appreciated that the spacer elements 126 may be arranged with any random or periodic pattern and in any number appropriate to provide the non-contacting relationship between end faces 64, 66 when the dispensing module 10 is opened. Referring specifically to FIG. 6C and in accordance with another alternative embodiment of the invention, end face 66 may include a spacer element 128 constituted by a circular ring of non-magnetic material substantially centered about longitudinal axis 27. Referring specifically to FIG. 6D and in accordance with another alternative embodiment of the invention, end face 66 may include a plurality of radially-extending spacer elements 130 of non-magnetic material arranged as linear chords relative to the longitudinal axis 27. Referring specifically to FIG. 6E and in accordance with another alternative embodiment of the invention, end face 66 may include a plurality of spacer elements 132 of non-magnetic material arranged as line segments, which are depicted as being substantially parallel. Referring to FIG. 6F and in accordance with another alternative embodiment of the invention, end face 66 may include a plurality of spacer elements 134 of non-magnetic material arranged as curved segments in a circular pattern about a radius measured relative to longitudinal axis 27. Referring to FIG. 6G and in accordance with another alternative embodiment of the invention, end face 66 may include a plurality of spacer elements 136 of non-magnetic material arranged as linear segments oriented tangentially with respect to an imaginary circle of a selected radius measured relative to the longitudinal axis 27. In each of these alternative embodiments, the spacer element(s) 126, 128, 130, 132, 134 and 136 project axially outward beyond the end face 66 by a distance sufficient to provide a non-contacting relationship between end faces 64, 66. The separation is effective for permitting rapid demagnetization of the armature 14 and pole piece 16 after the electromagnetic coil 18 is de-energized.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. The invention itself should only be defined by the appended claims, wherein I claim:

What is claimed is:

1. An electrically-operated dispensing module for dispensing a viscous liquid, comprising:

a module body having an outer housing and a liquid outlet;

a pole piece in said module body;

an armature disposed in said module body and movable relative to said pole piece between an opened position allowing liquid flow from said liquid outlet and a closed position preventing liquid fluid flow from said liquid outlet;

an electromagnetic coil for selectively generating an electromagnetic field capable of moving said armature between said opened and closed positions; and a flux element positioned with a surrounding relationship about at least one of said electromagnetic coil, said armature and said pole piece, said flux element forming at least a portion of said outer housing of said module body, said flux element including a portion capable of interrupting circumferential electrical current paths in said flux element.

2. The electrically-operated dispensing module of claim 1 wherein said portion is a slot with a width effective to prevent circumferential electrical currents in said flux element.

3. The electrically-operated dispensing module of claim 2 wherein said flux element and said electromagnetic coil are aligned along a longitudinal axis, said flux element has an axial dimension, and said slot extends fully along said axial dimension of said flux element for defining a gap.

4. The electrically-operated dispensing module of claim 3 wherein said slot is substantially aligned with said longitudinal axis.

5. The electrically-operated dispensing module of claim 1 wherein said portion is formed from an electrically insulating material, said flux element and said electromagnetic coil are aligned along a longitudinal axis, said flux element has an axial dimension, and said electrically-insulating material extends along the entire axial dimension of said flux element.

6. The electrically-operated dispensing module of claim 1 wherein said module body has upper and lower body portions, said flux element positioned between said upper and lower body portions and having a rectangular cross-sectional profile.

7. The electrically-operated dispensing module of claim 1 wherein said armature includes a central flow passageway and a plurality of angled flow passageways coupling said central flow passageway in fluid communication with said liquid outlet.

8. The electrically-operated dispensing module of claim 1 wherein said module body has a lower body portion and an upper body portion with a liquid inlet receiving viscous liquid, said liquid outlet is defined in said lower body portion, said electromagnetic coil is positioned between said upper and lower body portions, said upper body portion includes a liquid inlet receiving viscous liquid, and said liquid inlet is coupled in fluid communication with said liquid outlet when said armature is in said opened position.

9. An electrically-operated dispensing module for dispensing a viscous liquid, comprising:

a module body having a liquid outlet;

a pole piece disposed in said module body and including a first end face;

an armature disposed in said module body and including a second end face having a confronting relationship with said first end face of said pole piece, said armature movable relative to said pole piece between an opened position allowing liquid flow from said liquid outlet and a closed position preventing liquid flow from said liquid outlet;

an electromagnetic coil operative for selectively generating an electromagnetic field capable of moving said armature between said opened and closed positions; and at least one spacer element projecting from said first end face of said pole piece, said at least one spacer element formed from a non-magnetic material selected from the group consisting of austenitic stainless steels and ceramics, said at least one spacer element being configured to maintain said first and second end faces with a non-contacting relationship when said armature is in said opened position.

10. The electrically-operated dispensing module of claim 9 wherein said at least one spacer element is a ring extending about said end face of said pole piece.

11. The electrically-operated dispensing module of claim 9 further comprising a plurality of spacer elements arranged about said end face of said pole piece.

12. The electrically-operated dispensing module of claim 9 wherein said module body has a lower body portion and an upper body portion with a liquid inlet receiving viscous liquid, said liquid outlet being defined in said lower body portion, said electromagnetic coil is positioned between said upper and lower body portions, and said liquid inlet coupled in fluid communication with said liquid outlet when said armature is in said opened position.

13. The electrically-operated dispensing module of claim 9 further comprising a flux element positioned with a surrounding relationship about at least one of said electromagnetic coil, said armature and said pole piece, said flux element including a portion capable of interrupting circumferential electrical current paths in said flux element.

14. An electrically-operated dispensing module for dispensing a viscous liquid, comprising:

a module body having a liquid outlet;

an electromagnetic coil operative for selectively generating an electromagnetic field, said electromagnetic coil including a plurality of solenoidal windings extending along a longitudinal axis between first and second axial positions, said first axial position being closer to said liquid outlet than said second axial position;

a pole piece disposed in said module body and including a first end face;

an armature disposed in said module body and capable of being moved relative to said pole piece by said electromagnetic field between an opened position allowing liquid flow from said liquid outlet and a closed position preventing liquid flow from said liquid outlet, said armature including a second end face confronting said first end face of said pole piece at a third axial position located between a midpoint of said first and second axial positions and said first axial position; and at least one spacer element projecting from said first end face of said pole piece, said at least one spacer element formed from a non-magnetic material and configured to maintain said first and second end faces in a non-contacting relationship when said armature is in said opened position.

15. The electrically-operated dispensing module of claim 14 wherein said third axial position is located approximately halfway between said midpoint and said first axial position.

16. The electrically-operated dispensing module of claim 14 wherein said module body has a lower body portion and an upper body portion with a liquid inlet receiving viscous liquid, said liquid outlet being defined in said lower body portion, said electromagnetic coil is positioned between said upper and lower body portions, and said liquid inlet is coupled in fluid communication with said liquid outlet when said armature is in said opened position.

17. The electrically-operated dispensing module of claim 16 wherein said pole piece includes a first flow passageway coupled in fluid communication with said liquid inlet and said armature includes a second flow passageway coupling said first flow passageway in fluid communication with said liquid outlet.

18. The electrically-operated dispensing module of claim 14 further comprising a flux element positioned with a surrounding relationship about at least one of said electromagnetic coil, said armature and said pole piece, said flux element including a portion capable of interrupting circumferential electrical current paths in said flux element.

19. An electrically-operated dispensing module for dispensing a viscous liquid, comprising:

a module body having a lower body portion with a liquid outlet and an upper body portion;

a pole piece disposed in said module body;

an armature disposed in said module body and movable relative to said pole piece between an opened position allowing liquid flow from said liquid outlet and a closed position preventing liquid fluid flow from said liquid outlet;

an electromagnetic coil operative for selectively generating an electromagnetic field capable of moving said armature between said opened and closed positions;

a return spring biasing said armature axially away from said pole piece; and a nozzle removably attached to said lower body portion and having a hollow interior which contains a majority of said return spring.

20. The electrically-operated dispensing module of claim 19 wherein at least about 75% of said return spring is contained in said hollow interior of said nozzle.

21. The electrically-operated dispensing module of claim 19 wherein said armature includes a radially-extending flange positioned within said hollow interior and said module body includes a shoulder, said return spring being held between said flange and said shoulder.

22. The electrically-operated dispensing module of claim 19 further comprising a flux element positioned with a surrounding relationship about at least one of said electromagnetic coil, said armature and said pole piece, said flux element including a portion capable of interrupting circumferential electrical current paths in said flux element.

23. The electrically-operated dispensing module of claim 19 wherein said pole piece includes a first end face and said armature includes a second end face having a confronting relationship with said first end face of said pole piece; and further comprising:

at least one spacer element projecting from said first end face of said pole piece, said at least one spacer element formed from a non-magnetic material, said at least one spacer element being configured to maintain said first and second end faces with a non-contacting relationship when said armature is in said opened position.

24. An electrically-operated dispensing module for dispensing a heated viscous liquid, comprising:

a module body having a liquid outlet;

a pole piece disposed in said module body;

an armature disposed in said module body and movable relative to said pole piece between an opened position allowing liquid flow from said liquid outlet and a closed position preventing liquid fluid flow from said liquid outlet;

an electromagnetic coil operative for selectively generating an electromagnetic field capable of moving said armature between said opened and closed positions; and an armature guide sleeve guiding said armature between said open and closed positions, said armature guide sleeve joined by a weldment with said module body, and said armature guide sleeve being formed from a first non-magnetic material and said module body being formed from a second non-magnetic material having a thermal conductivity greater than said first non-magnetic material.

25. The electrically-operated dispensing module of claim 24 wherein said first non-magnetic material has a thermal conductivity greater than about 20 W/(m·K) measured at room temperature.

26. The electrically-operated dispensing module of claim 24 wherein said first non-magnetic material is an austenitic stainless steel and said second non-magnetic material is a nickel-free copper alloy capable of being joined by said weldment with austenitic stainless steel.

27. The electrically-operated dispensing module of claim 24 wherein said module body includes a lower body portion containing said liquid outlet and an upper body portion separated from said lower body portion by said coil, said armature guide sleeve being joined to said lower body portion by said weldment.

28. An electrically-operated dispensing module for dispensing a viscous liquid, comprising:

a module body having an outer housing, a lower body portion with a liquid outlet, and an upper body portion;

an electromagnetic coil operative for selectively generating an electromagnetic field, said electromagnetic coil including a plurality of solenoidal windings extending along a longitudinal axis between first and second axial positions, said first axial position being closer to said liquid outlet than said second axial position;

a pole piece disposed in said module body and including a first end face;

an armature disposed in said module body and capable of being moved relative to said pole piece by said electromagnetic field between an opened position allowing liquid flow from said liquid outlet and a closed position preventing liquid fluid flow from said liquid outlet, said armature including a second end face confronting said first end face of said pale piece at a third axial position located between a midpoint of said first and second axial positions and said first axial position;

at least one spacer element projecting from said first end face of said pole piece, said at least one spacer element formed from a non-magnetic material, said at least one spacer element being configured to maintain said first and second end faces with a non-contacting relationship when said armature is in said opened position;

a flux element positioned with a surrounding relationship about at least one of said electromagnetic coil, said armature and said pole piece, said flux element forming at least a portion of said outer housing of said module body, said flux element including a portion capable of interrupting circumferential electrical current paths in said flux element;

a return spring biasing said armature axially away from said pole piece;

a nozzle removably attached to said lower body portion and having a hollow interior which contains a majority of said return spring; and an armature guide sleeve guiding said armature between said open and closed positions, said armature guide sleeve joined by a weldment with said module body, and said armature guide sleeve being formed from a first non-magnetic material and said module body being formed from a second non-magnetic material having a thermal conductivity greater than said first non-magnetic material.

29. A method of operating an electrically-operated dispensing module for dispensing a viscous liquid, the dispensing module having a module body with a liquid outlet, a pole piece, and an armature movable relative to the pole piece between an opened position allowing liquid flow from the liquid outlet and a closed position preventing liquid fluid flow from the liquid outlet, the method comprising:

energizing an electromagnetic coil to generate an electromagnetic field for moving the armature relative to the pole piece from the closed position to the opened position;

maintaining the armature and the pole piece in a non-contacting relationship while the electromagnetic coil is energized with a non-magnetic spacer element integral with the pole piece;

directing the flux of the electromagnetic field to a flux element; and interrupting circumferential electrical current paths in the flux element while the electromagnetic coil is energized.

* * * * *

UNITED STATES PATENT AND TRADEMARK OFFICE

CERTIFICATE OF CORRECTION

PATENT NO. : 6,994,234 B2
DATED : February 7, 2006
INVENTOR(S) : Victor de Leeuw It is certified that error appears in the above-identified patent and that said Letters Patent is hereby corrected as shown below:

Column 5,
Line 1, after "' above' " insert -- "below" --.

Column 12,
Line 55, after "piece" insert -- disposed --.
Line 61, after "coil" insert -- operative --.

Column 16,
Line 36, change "pale" to -- pole --.

Signed and Sealed this

Sixth Day of June, 2006

JON W. DUDAS
*Director of the United States Patent and Trademark Office*